US010422057B2

(12) United States Patent
Şençopur

(10) Patent No.: US 10,422,057 B2
(45) Date of Patent: Sep. 24, 2019

(54) KNITTING YARN AND METHOD OF FORMING A KNITTED PRODUCT

(71) Applicant: YÜNTEKS TEKSTIL SANAYI VE TICARET LIMITED SIRKETI, Isparta (TR)

(72) Inventor: Mehmet Abdullah Şençopur, Isparta (TR)

(73) Assignee: YÜNTEKS TEKSTIL SANAYI VE TICARET LIMITED SIRKETI, Isparta (TR)

( * ) Notice: Subject to any disclaimer, the term of this patent is extended or adjusted under 35 U.S.C. 154(b) by 0 days.

(21) Appl. No.: 16/025,266

(22) Filed: Jul. 2, 2018

(65) Prior Publication Data

US 2018/0305845 A1 Oct. 25, 2018

Related U.S. Application Data

(63) Continuation-in-part of application No. 15/726,781, filed on Oct. 6, 2017, now abandoned.

(30) Foreign Application Priority Data

Mar. 27, 2017 (TR) ..... a 2017 04579

(51) Int. Cl.
*D04B 1/04* (2006.01)
*D02G 3/34* (2006.01)
(Continued)

(52) U.S. Cl.
CPC ..... *D04B 1/04* (2013.01); *D02G 3/34* (2013.01); *D02G 3/44* (2013.01); *D04B 1/22* (2013.01); *D04B 3/00* (2013.01)

(58) Field of Classification Search
CPC ... D04B 3/00; D04B 3/02; D04B 3/04; D04B 5/00; D04B 1/02; D04B 1/025; D04B 1/04; D04B 1/12
(Continued)

(56) References Cited

U.S. PATENT DOCUMENTS 167,563 A * 9/1875 Polle et al. ..... D04B 3/00 66/1 A
1,318,465 A * 10/1919 Seifarth ..... D04B 39/00 66/4
(Continued)

OTHER PUBLICATIONS

Y.E. El Mogahzy, Integrating the Design and Manufacture of Textile Products, (2009) Woodhead Publishing Series in Textiles, Chapter 9.3.3, pp. 255-258. (Year: 2009).*

*Primary Examiner* — Danny Worrell
(74) *Attorney, Agent, or Firm* — Gokalp Bayramoglu

(57) ABSTRACT

A method of manually forming a knitted product without tools includes forming a knitting yarn having a thread with a plurality of loops extending outwardly of the thread in spaced relationship to each other, arranging the knitting yarn into a plurality of rows, threading one loop of the plurality of loops of one of the plurality of rows through an interior of another loop of the to another loop of another plurality of rows, and repeating the steps until the knitted product is formed. The knitting yarn has a thread and a plurality of loops affixed to or formed with the thread. These loops are in spaced relationship to each other along the length of the thread. The loops extend outwardly of only one side of the thread.

12 Claims, 3 Drawing Sheets

(51) Int. Cl.
*D04B 1/22* (2006.01)
*D02G 3/44* (2006.01)
*D04B 3/00* (2006.01)

(58) Field of Classification Search
USPC ..... 66/1 A, 1 R, 3, 4
See application file for complete search history.

(56) References Cited

U.S. PATENT DOCUMENTS 1,500,383 A * 7/1924 Gourie ..... D04B 17/00 28/149
1,532,810 A * 4/1925 Gourley ..... D04C 1/00 66/1 A
1,635,547 A * 7/1927 Gourie ..... D04B 17/00 66/4
1,691,527 A * 11/1928 Sakurai ..... D04B 17/00 28/149
1,705,860 A * 3/1929 Hagihara ..... D04B 17/00 66/4
1,718,140 A * 6/1929 Hagihara ..... D04B 17/00 66/4
1,738,486 A * 12/1929 Wesseler ..... D04B 9/44 66/1 A
2,270,619 A * 1/1942 Bowyer ..... D04B 39/00 66/4
2,382,614 A * 8/1945 De La Pena ..... D04B 39/00 66/4
2,609,676 A * 9/1952 Woroneski ..... D04G 3/02 66/4
2,803,051 A * 8/1957 Gutzmann ..... D04D 11/00 28/150
3,234,759 A * 2/1966 Larrasoain ..... D04B 9/54 66/1 A
3,535,891 A * 10/1970 Corey ..... D04B 1/06 66/1 A
3,577,748 A * 5/1971 Nortland ..... D04B 39/00 66/4
3,868,834 A * 3/1975 Tichenor ..... D04B 39/00 66/1 A
4,351,148 A * 9/1982 Eschenbach ..... D02G 1/162 57/208
4,750,324 A * 6/1988 Tochacek ..... D02G 3/16 57/210
9,027,366 B2 * 5/2015 Raynor ..... D04B 3/00 66/1 A
9,334,589 B2 * 5/2016 Eddy ..... D04B 5/00
2009/0019614 A1 * 1/2009 Hagihara ..... A41D 19/01529 2/16

* cited by examiner

KNITTING YARN AND METHOD OF FORMING A KNITTED PRODUCT

CROSS-REFERENCE TO RELATED APPLICATIONS

The present application is a continuation-in-part of U.S. application Ser. No. 15/726,781, filed on Oct. 6, 2017, and entitled "Thread with Rings and Knitting Method Using the Thread with Rings", abandoned on 10/30/2018. U.S. application Ser. No. 15/726,781 claims priority from Turkish Patent Application No. 2017/04579, filed on Mar. 27, 2017.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

Field of the Invention

The present invention relates to knitting yarn. More particularly, the present invention relates to knitting yarn that has a configuration whereby knitted products can be formed without tools, such as needles. More particularly, the present invention relates to methods for forming a knitted product.

Description of Related Art

Knitting apparatus, such as crochet hooks or knitting needles are used when knitting is carried out with threads or yarns. Since the knitting procedures, including the use of such tools, requires one to learn the specifics of knitting, it is quite difficult for a person without skills to properly knit products using normal conventional threads. Even if such a person would have experience and skill in knitting, it still takes a significant amount of time for such a person to knit large items. As such, a need has developed to provide a knitting yarn and method of forming a knitted product which allows a person to quickly learn procedures for forming the knitted product and allows the person to carry out the knitting manually without the use of any tools, such as crochet hooks or knitting needles.

U.S. Pat. No. 1,705,860, issued on Mar. 19, 1929 to E. Hagihara, describes a knitting tool having a body of a rectangular bar shape having flat sides and a longitudinal groove, a plurality of root members adapted to fit in the groove so as to be sustained in position therein, a plurality of spaced pins of substantially straight form having disk-shaped heads with their flat sides perpendicular to the plane of the side of the body, a second body member similar to the first body, a plurality of root members similar to the first group members, and a plurality of spaced pins of a curved form having substantially spherical heads projecting in the concave sides of the curved pins. The bodies are arranged to cooperate with each other.

In this patent, knitting tools such as pins and boards are required. Only a simple yarn is used. As such, only a single thread with no other surfaces is used. The Hagihara patent is not suitable for the knitting of large surface fabrics because the size of the apparatus is of a fixed dimension. The Hagihara patent does not allow one to produce knitted products in a simple, fast and efficient matter by individuals with a limited amount of skill.

It is an object of the present invention to provide a knitting yarn and method of forming a knitted product which does not require the use of tools, such as crochet hooks, knitting needles, and pins.

It is another object of the present invention to provide a knitting yarn and method of forming a knitted product which allows for knitting with no special training or experience.

It is another object of the present invention to provide a knitting yarn and method of forming a knitted product that can be used by persons of all ages.

It is another object of the present invention to provide a knitting yarn and method of forming a knitted product which can facilitate the development of children in terms of dexterity and mathematical knowledge.

It is still another object of the present invention provide a knitting yarn and method of forming a knitted product which can be sized to the desired dimensions of the knitted product.

It is another object of the present invention provide a knitting yarn and method of forming a knitted product which eliminates any stiffness, rigidity, or hardness in the knitted product.

It is still a further object of the present invention to provide a knitting yarn and method of forming a knitted product which is easy to use, easy to manufacture and relatively inexpensive.

These and other objects and advantages of the present invention will become apparent from a reading of the attached specification and appended claims.

BRIEF SUMMARY OF THE INVENTION

The present invention is a knitting yarn for manually forming a knitted product without tools. The knitting yarn comprises a thread having a length dimension, and a plurality of loops affixed to or formed with the thread. The plurality of loops are in spaced relationship to each other along the length dimension of the thread. Each of the plurality of loops defines an interior adapted to receive another loop of the plurality of loops.

The plurality of loops extends outwardly of only one side of the thread. Each of the plurality of loops has a first end affixed to or formed with the thread and a second end affixed to or formed with the thread. The first end is in spaced relation to the second end. The interior of each of the plurality of loops has a width that is greater than the distance between the first and second ends of the loop. Each of the plurality of loops has an identical configuration and is flexible. The plurality of loops and the thread are formed of an identical material.

The present invention is also a method of forming a knitted product without tools. The method comprises the steps of: (1) forming a knitting yarn having a thread with a plurality of loops extending outwardly of the thread in which each of the plurality of loops is in spaced relationship to each other; (2) arranging the knitting yarn into a plurality of rows; and (3) threading one loop of the plurality of loops of one of the plurality of rows through an interior of another loop of the second plurality of loops of another row of the plurality of rows; and (4) repeating steps (2) and (3) until the knitted product is obtained.

The plurality of rows of the knitting yarn includes a first row and a second row. The step of threading comprises inserting the loop from the second row into the interior of the loop of the first row. The loops of the first and second rows are generally aligned with each other. The loop of the first row is aligned with a corresponding loop of the second row. The step of inserting includes inserting all of the loops of the second row into the interior of all of the respective corresponding loops of the first row. That plurality of rows of the knitting yarn will include a third row. The step of threading further includes inserting the loop of the third row into the interior of all of the respective corresponding loops of the second row. These steps of inserting are continued until a final row is obtained.

The method further includes binding the loops of the final row together. In particular, the step of binding includes inserting a first loop of the final row through the interior of an adjacent loop in the final row, and inserting a third loop of the final row through an interior of the first loop of the final row. The third loop is to a side of the first loop opposite second loop. A fourth loop is inserted into the fourth loop of the final row is inserted into an interior of the third loop. The interior of the third loop extends outwardly of the first loop. The steps of inserting are repeated until all of the loops of the final row are inserted one into the other. The last loop of the final row is locked into a knot into an adjacent loop to a side of the last loop.

This foregoing Section is intended to describe, with particularity, the preferred embodiments of the present invention. It is understood that modifications to these preferred embodiments can be made within the scope of the appended claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
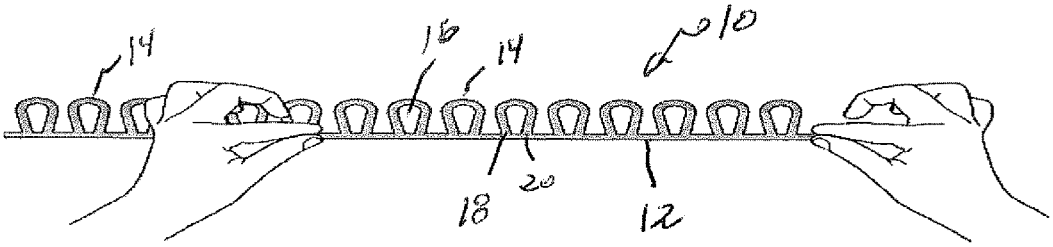
FIG. 1 is a side elevational view of the knitting yarn in accordance with the teachings of the present invention.

Referring to FIG. 1, there is shown the knitting yarn 10 in accordance with the teachings of the present invention. The knitting yarn 10 includes a thread 12 that has a length dimension. A plurality of loops 14 are affixed to or formed with the thread 12. The plurality of loops 14 are in spaced relationship to each other along the length dimension of the thread 12. Each of the plurality of loops 14 defines an interior 16. Interior 16 is adapted to receive another loop therein.

Each of the plurality of loops 14 extend outwardly of only one side of the thread 12. Each of the plurality of loops has a first end 18 and a second end 20 joined to the thread 12. The first end 18 is in spaced relationship to the second thread 20. It can be seen that the interior 16 of the loop 14 has a width dimension that is greater than a distance between the first end 18 and the second end 20 of each loop 14. Each of the plurality of loops 14 has an identical configuration. The thread 12 in the plurality of loops 14 are flexible. They plurality of loops 14 and the thread 12 are formed of an identical material.

Within the concept of the present invention, the thread the knitting yarn 10 is produced by machines having the ring structure for loops. The structure allows a portion of the knitted product to be prepared and woven manually. The knitting yarn 10 can be structured specifically to the knitted product that is to be formed. In particular, the size of the thread 12, the spaces between the plurality of loops 14, the loop thickness, and the loop height are calculated so as to provide a product that is formed in the desired dimensions. These dimensions are produced so as to be constant throughout the knitting yarn.

Figure 2:
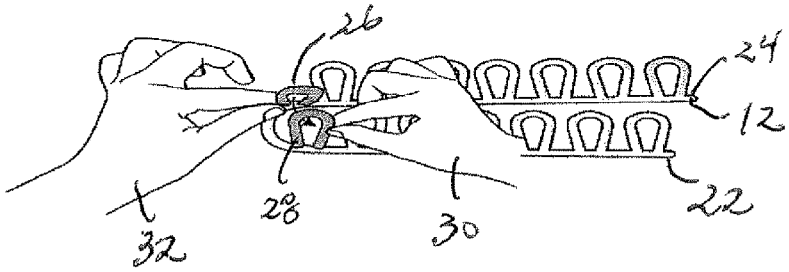
FIG. 2 illustrates a first step in the process of forming a knitted product.

FIG. 2 shows an initial step in the method of the present invention. In particular, in this method, it will be appreciated that a knitted product can be formed without tools, such as crochet hooks, knitting needles or pins. Additionally, it will be appreciated that the knitted product is formed in a simple, effective and efficient manner by persons having limited skill.

In FIG. 2, it can be seen that the thread 12 is arranged in a first row 22 and a second row 24. The loop 26 of the second row 24 is directed to the corresponding and aligned loop 28 of the first row 22. FIG. 2 shows that the rows 22 and 24 are aligned so that the loops of the first row 22 will generally correspond in location respectively to the loops of the second row 24. FIG. 2 shows human hands 30 and 32 as grasping the respective loops 28 and 26.

Figure 3:
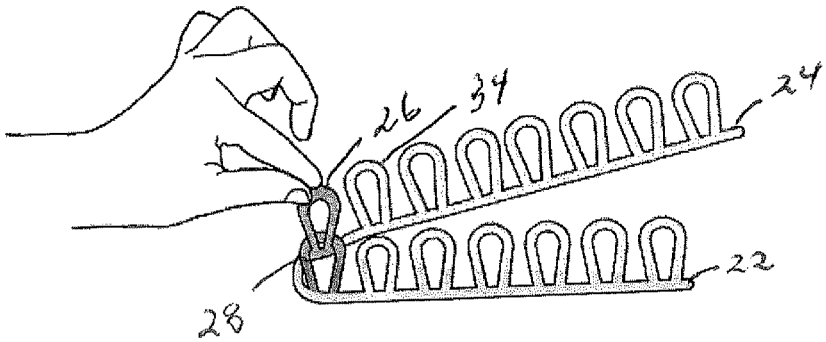
FIG. 3 shows a second step in the process of forming a knitted product of the present invention.

FIG. 3 shows a further step in the process of forming the knitted product. In particular, it can be seen that the loop 26 of the second row 24 is extended through the interior of the loop 28 of the first row 22. As such, a portion of the exterior of the loop 28 will reside in the space between the loop 26 and the loop 34 of the second row 24.

Figure 4:
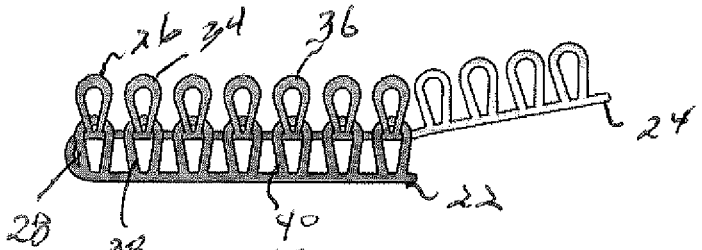
FIG. 4 shows a further step in the method of forming a knitted product of the present invention.

FIG. 4 shows a further step in the process of the present invention. In particular, it can be seen that the various loops 26, 34 and 36 of the second row 24 are extended through corresponding loops 28, 38 and 40 of the first row 22. This process will continue until all of the loops of the first row 22 are joined to all of the loops of the second row 24.

Figure 5:
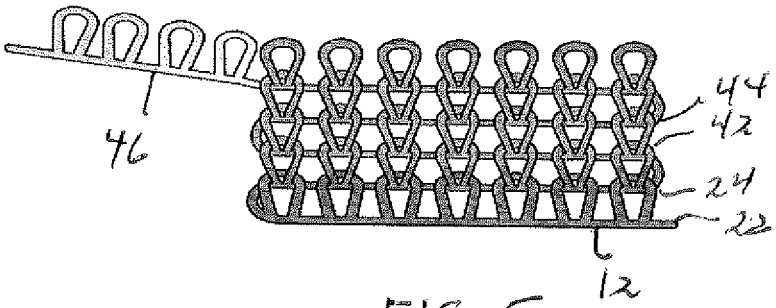
FIG. 5 shows a further step in the process of forming a knitted product in the present invention in which several rows are linked together.

FIG. 5 shows a further step in the process of forming a knitted product of the present invention. In FIG. 5, there are a plurality of rows of threads and loops that are joined together. In particular, the loops of the first row 22 are joined in the manner described herein previously to the loops of the second row 24. The loops of the second row 24 are joined in a similar manner as described hereinbefore to the loops of a third row 42. The loops of the third row 42 are joined in a similar manner to the loops of a fourth row 44. The loops of another row 46 are received within the interior of each of the loops of the fourth row 44. It can be seen that the thread 12 is continuous amongst the various rows 22, 24, 42 and 44. The thread 12 will curve back and forth between the various rows.

The process shown in FIG. 5 will continue in a similar manner until the final product is obtained. For example, there could be hundreds of the various rows required in order to make the finished product. Each of the rows can have an extended length. In normal use, a person will manually manipulate each of the loops of each of the rows so as to twine these loops together in the manner described herein previously until the desired size of the finished product is accomplished. It is then necessary to create a final row and to bind the loops of the final row together.

Figure 6:
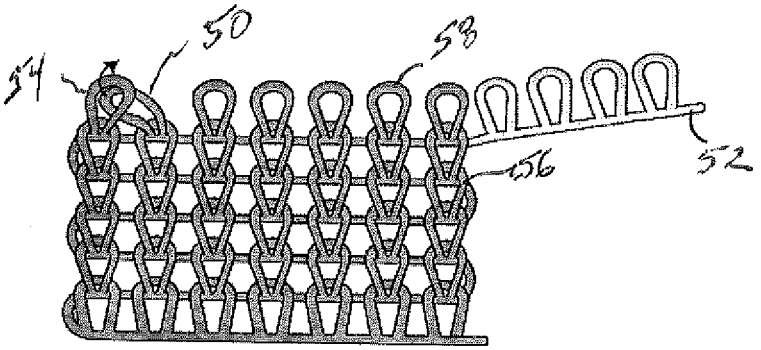
FIG. 6 is an illustration showing the binding of the final row of the knitted product of the present invention.

FIG. 6 shows an initial step in the binding of the loops of the final row together. In particular, there is a first loop 50 in the final row 52 that is inserted into a second loop 54 of the final row 52. The arrow shows the direction that the first loop 50 should be pulled in order to bind the final row 52. FIG. 6 further shows that the various loops of the next-to-final row 56 are intertwined with the various loops 58 of the final row 52.

Figure 7:
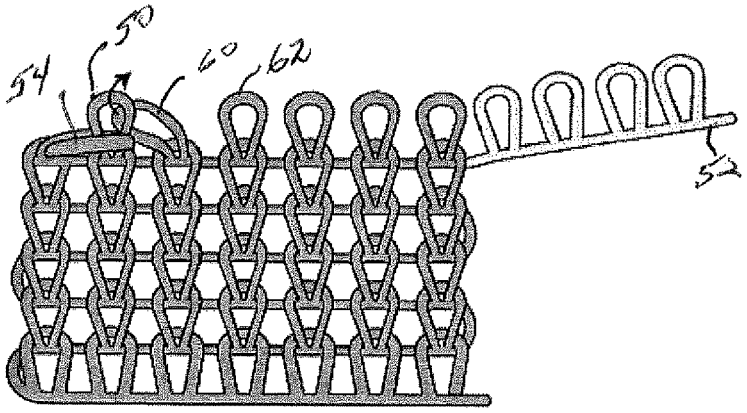
FIG. 7 shows a further step in the binding of the final row of the knitted product.

FIG. 7 shows a further step in the binding of the loops together in the final row 52. In particular, there is a third loop 60 that is inserted into the interior of the first loop 50. In particular, the third loop 60 is inserted into a portion of the interior of the first loop 50 that extends outwardly of the second loop 54. The third loop 60 can then be moved in the direction of the arrow in FIG. 7 so as to approach a fourth loop 62.

Figure 8:
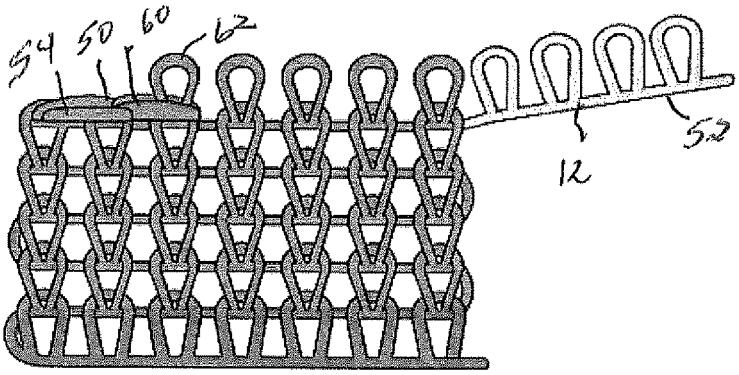
FIG. 8 shows a still further step in the binding of the final row of the knitted product of the present invention.

FIG. 8 shows a further process of binding the loops of the final row 52 together. In particular, the third loop 60 is extended over and around the fourth loop 62. This causes the second loop 54 and the first loop 50 to be tightly squeezed together along the thread 12. This process will continue until all of the loops of the final row 52 are joined together.

Figure 9:
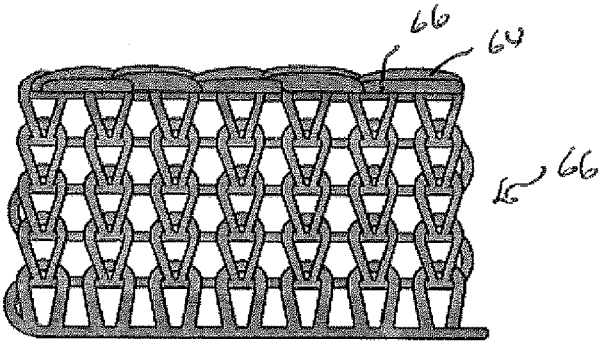
FIG. 9 is in a is a side elevational view showing a completed knitted product in accordance with the teachings of the present invention.

FIG. 9 shows the final step in forming the knitted product of the present invention. In FIG. 9, the final loop 64 is joined to the adjacent loop 66 and sealed thereto. This sealing can occur by the knotting of the final loop to the adjacent loop. Also, this sealing could occur by applying adhesives, stapling, or being sewed together. As such, FIG. 9 shows the finished product 66 in accordance with the teachings of the present invention.

The method of the present invention creates the final product 66 with no knitting tools. All of the knitting is carried out by hand. Only a single length of the knitting yarn is used. The yarns can be produced in the desired thickness and size, along with the desired loop spacing and loop size. The yarn of the present invention can be thick or thin. The knitting yarn of the present invention can be used so as to achieve a wide variety of knitted final products. The present invention allows one to easily and efficiently form products such as blankets, covers etc. which have a very large surface area.

Loop continuity and distance are important in the knitting yarn of the present invention. It should also be noted that different knitting techniques can be obtained by passing the loops through in different directions and ways. For example, if one loop is left empty, and the other loop is passed, a different view/result can be obtained.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A method of manually forming a knitted product without tools, the method comprising:

(a) forming a knitting yarn having a thread with a plurality of loops extending outwardly of the thread, wherein, the plurality of loops are in spaced relation to each other;

(b) arranging the knitting yarn into a plurality of rows;

(c) threading one loop of the plurality of loops of one of the plurality of rows through an interior of another loop of the plurality of loops of another row of said plurality of rows; and (d) repeating steps (b) and (c) until the knitted product is formed.

2. The method of claim 1, the plurality of rows of the knitting yarn having a first row and a second row, the step of threading comprising:

inserting the loop from the second row into the interior of the loop of the first row.

3. The method of claim 2, the loops of the first and second rows being generally aligned with each other, the loop of the first row being generally aligned with the corresponding loop of the second row.

4. The method of claim 3, the step of inserting comprising:

inserting all of the loops of the second row into the interior of all of the respective corresponding loops of the first row.

5. The method of claim 4, the knitting yarn having a third row, the step of threading further comprising:

inserting all of the loops of the third row into the interior of all of the respective corresponding loops of the second row.

6. The method of claim 5, further comprising:

continuing the steps of inserting until a final row is obtained.

7. The method of claim 6, further comprising:

binding the loops of the final row together.

8. The method of claim 7, the step of binding comprising:

inserting a first loop of the final row through the interior of an adjacent second loop of the final row; and inserting a third loop of the final row through an interior of the first loop of the final row, the third loop being to a side of the first loop opposite the second loop.

9. The method of claim 8, the step of binding further comprising:

inserting a fourth loop of the final row through an interior of the third loop, the interior of the third loop extending outwardly of the first loop.

10. The method of claim 9, the step of finding further comprising:

repeating the steps of inserting until all of the loops of the final row are inserted one into another.

11. The method of claim 10, further comprising:

locking a last loop of the final row into a knot into an adjacent loop to a side of the last loop.

12. A method of manually forming a knitted product without tools, the method comprising:

(a) forming a knitting yarn having a thread with a plurality of loops extending outwardly of the thread, wherein, the plurality of loops are in spaced relation to each other;

(b) arranging the knitting yarn into a plurality of rows;

(c) threading one loop of the plurality of loops of one of the plurality of rows through an interior of another loop of the plurality of loops of another row of said plurality of rows; and (d) repeating steps (b) and (c) until the knitted product is formed;

the plurality of rows of the knitting yarn having a first row and a second row, the step of threading comprising:

inserting the loop from the second row into the interior of the loop of the first row;

the loops of the first and second rows being generally aligned with each other, the loop of the first row being generally aligned with the corresponding loop of the second row inserting all of the loops of the second row into the interior of all of the respective corresponding loops of the first row;

inserting all of the loops of the third row into the interior of all of the respective corresponding loops of the second row;

continuing the steps of inserting until a final row is obtained;

binding the loops of the final row together;

inserting a first loop of the final row through the interior of an adjacent second loop of the final row; and inserting a third loop of the final row through an interior of the first loop of the final row, the third loop being to a side of the first loop opposite the second loop.

* * * * *